US006497498B2

(12) United States Patent
Adams

(10) Patent No.: US 6,497,498 B2
(45) Date of Patent: Dec. 24, 2002

(54) OUTDOOR ORNAMENT KIT

(75) Inventor: William E. Adams, Portersville, PA (US)

(73) Assignee: Adams Mfg. Corp., Portersville, PA (US)

( * ) Notice: Subject to any disclaimer, the term of this patent is extended or adjusted under 35 U.S.C. 154(b) by 0 days.

(21) Appl. No.: 09/847,560

(22) Filed: May 1, 2001

(65) Prior Publication Data

US 2002/0163806 A1 Nov. 7, 2002

(51) Int. Cl.[7] ..... F21S 13/14

(52) U.S. Cl. ..... 362/252; 362/249; 362/806; 403/171

(58) Field of Search ..... 362/252, 249, 362/250, 240, 363, 358, 450, 807, 806, 452, 367, 238; 403/169, 171, 172, 176, 180, 182, 184

(56) References Cited

U.S. PATENT DOCUMENTS

| | | | | | |
|---|---|---|---|---|---|
| 1,347,808 | A | * | 7/1920 | Franklin | 403/171 |
| 2,722,317 | A | | 11/1955 | Goodwin | 362/806 |
| 3,184,366 | A | | 5/1965 | Claude | 362/806 |
| 4,523,260 | A | | 6/1985 | Duncan | 362/121 |
| 4,567,707 | A | * | 2/1986 | Herman | 52/586 |
| 4,890,206 | A | | 12/1989 | Lee | 362/227 |
| 5,141,192 | A | | 8/1992 | Adams | 348/231.8 |
| 5,165,207 | A | * | 11/1992 | Oehlke | 403/169 |
| 5,430,626 | A | | 7/1995 | Leffel | 362/121 |
| 5,683,172 | A | | 11/1997 | Huag | 362/252 |
| 5,772,166 | A | * | 6/1998 | Adams | 248/231.81 |
| 5,968,613 | A | | 10/1999 | Lin | 428/9 |
| 6,027,228 | A | | 2/2000 | Adams et al. | 362/252 |

* cited by examiner

*Primary Examiner*—Sandra O'Shea
*Assistant Examiner*—Bao Truong
(74) *Attorney, Agent, or Firm*—Buchanan Ingersoll, P.C.

(57) ABSTRACT

A kit for making decorative lawn ornaments has a set of rods and rod connectors that enable the rods to be connected together to form two dimensional shapes and three-dimensional structures. The rod connectors permit two rods to be connected end to end collinearly or to connect two or more rods together at a selected angle between pairs of connected rods. Light holders are also provided to enable strings of decorative lights to be attached to the rods.

19 Claims, 9 Drawing Sheets

OUTDOOR ORNAMENT KIT

BACKGROUND OF THE INVENTION

1. Field of the Invention

The present invention relates to decorative Christmas display ornaments that have a frame and decorative lights attached to the frame.

2. Description of Related Art

Many people decorate their houses during the Christmas season. It is quite common for people to string lights around the exterior of their house using hooks which are fastened to the walls, roof and gutters. Typically the lights are strung in straight lines along the edges or roof line of the house or around windows and doors. Various types of hooks are available to hold Christmas light strings ranging from threaded eyebolts to plastic clips. In my U.S. Pat. No. 5,141,192 I disclose one type of hook for hanging cords from a gutter or the like.

Another type of outdoor Christmas decorations are lawn ornaments. Christmas season lawn ornaments, both lighted and unlighted, and are available in many configurations, from Christmas trees to elves to manger scenes to Santa's sleigh and reindeers. Some of these ornaments are molded plastic structures molded to look like a reindeer, Santa Claus or other holiday character. Usually these ornaments are hollow and contain one or more light bulbs inside of them. Another common type of holiday lawn ornament has a frame and one or more strings of decorative light bulbs attached to the frame. The frame could be formed from bent wire or plastic shapes, plastic or metal rods or wood. One example of this type of ornament is disclosed in U.S. Pat. No. 5,683,172 to Huag. Most of these ornaments are sold fully assembled or in a few pieces that are easily connected together. Consequently, these ornaments must be sold and stored in relatively large boxes. Nearly all of these ornaments are designed to have a single shape when fully assembled.

Another common lawn ornament is a Christmas tree formed with a pole embedded in the ground having multiple strings of lights strung from the top of the pole or a set of inclined poles and then staked to the ground. This pattern forms a conical shape that resembles a Christmas tree, especially at night when the strings of lights are lit up and neither the pole nor the strings on which the lights are carried are visible. This type of decoration is disclosed in U.S. Pat. No. 3,704,366 to Korb et al.; U.S. Pat. No. 4,404,621 to Mauro; U.S. Pat. No. 4,620,270 to Laakso; U.S. Pat. No. 5,568,966 to Miller et al. and U.S. Pat. No. 5,712,002 to Rielly III. This type of tree typically is found in a commercial or public area, is over ten feet high, and was assembled by professionals. Some homeowners have created this type of tree in their yards. There are several kits available in the market that allow homeowners to easily create this type of ornament. One such kit is disclosed in my U.S. Pat. No. 6,027,228.

Because many people enjoy creating holiday decorations there is a demand for kits that enable the customer to create holiday decorations. Those kits that enable the customer to create more than one design are preferred by many people. One such craft kit in which selected pieces are placed in a netting assembly to create a decorative shape is disclosed in U.S. Pat. No. 5,968,613 to Lin. Goodwin in U.S. Pat. No. 2,722,317 discloses a lamp support structure than is an elongated flexible strip with spaced apart pockets sized to receive a decorative light socket. Several strips can be assembled into selected shapes such as a star or a bell. U.S. Pat. No. 3,184,366 to Claude and U.S. Pat. No. 4,523,260 to Duncan disclose star shaped displays in which a string of decorative lights is attach to a star shaped frame. Another star-shaped display is disclosed by Leffel in U.S. Pat. No. 5,430,626. That display is constructed from connectors that have a long arm and a short arm extending from an angular section. Yet another star display is disclosed by Lee in U.S. Pat. No. 4,890,206. That display is made from a set of mounting elements that hold lights from a Christmas light set. Each mounting element has a hole at opposite ends and a dowel pin on one face opposite a socket on the reverse side. The dowel pin of one mounting element fits into the socket of another mounting element. The displays disclosed by most of these prior art patents are flat structures made from a set of pieces that can be assembled in only one size and usually in only one shape. The three dimensional display disclosed by Huag is created from a large number of differently shaped pieces. Consequently, this display is much more expensive than the simple flat displays disclosed in the other references. There is a need for a holiday ornament kit that will enable the user to create a variety of both flat and three-dimensional shapes that can be easily assembled by a homeowner. Although the art has attempted to create such kits they have met with only limited success because the art has not developed a connector that will enable straight pieces to be joined at several different angles without breaking or becoming disconnected.

SUMMARY OF THE INVENTION

I provide a holiday ornament kit containing a plurality of rods having a limited degree of flexibility and a set of connectors that enable two or more rods to be connected together at a variety of different angles. The connector has two or more arms, each arm having a flat base and two spaced apart loops. The loops form two spaced apart openings on a common centerline, each opening having a diameter close to the diameter of the rods. A stop is provided at a selected distance from one of the loops and a bump or ridge is provided a short distance away from the second loop. The ridge bends the rod being held in the loops slightly improving the grip of the connector on the rods. The two or more anns are connected together at a permanent angle or are pivotably connected and thus able to be positioned in a number of selected angles. For some purposes, the arms are made of a flexible material to enable the ends of the arms to move relative to one another. I prefer to provide a flexible locking arm that will retain the pivotably connected arms at a selected angle. Some of the connectors may have holes of a diameter close to the diameter of the rods for connecting rods perpendicular to one another. The rods may have a circular, oval; or polygon cross-section. The rods preferably are fiberglass and ¼ inch in diameter. Such rods have some flexibility. Consequently, the flexibility of the rods and the flexibility of the connectors enables one to create geodesic domes as well as flat structures. Tubular connectors can be provided to attach two rods end to end. After the rods are joined together by rod connectors decorative light holders are attached to the rods to hold one or more strings of decorative lights.

Other details, objects, and advantages of the invention will become apparent from the following description and accompanying drawings of certain presently preferred embodiments thereof.

BRIEF DESCRIPTION OF THE DRAWING FIGURES

In the accompanying drawings, the preferred embodiments of the invention and preferred method of practicing the invention are illustrated in which.

DETAILED DESCRIPTION OF CERTAIN EMBODIMENTS

Figure 1:
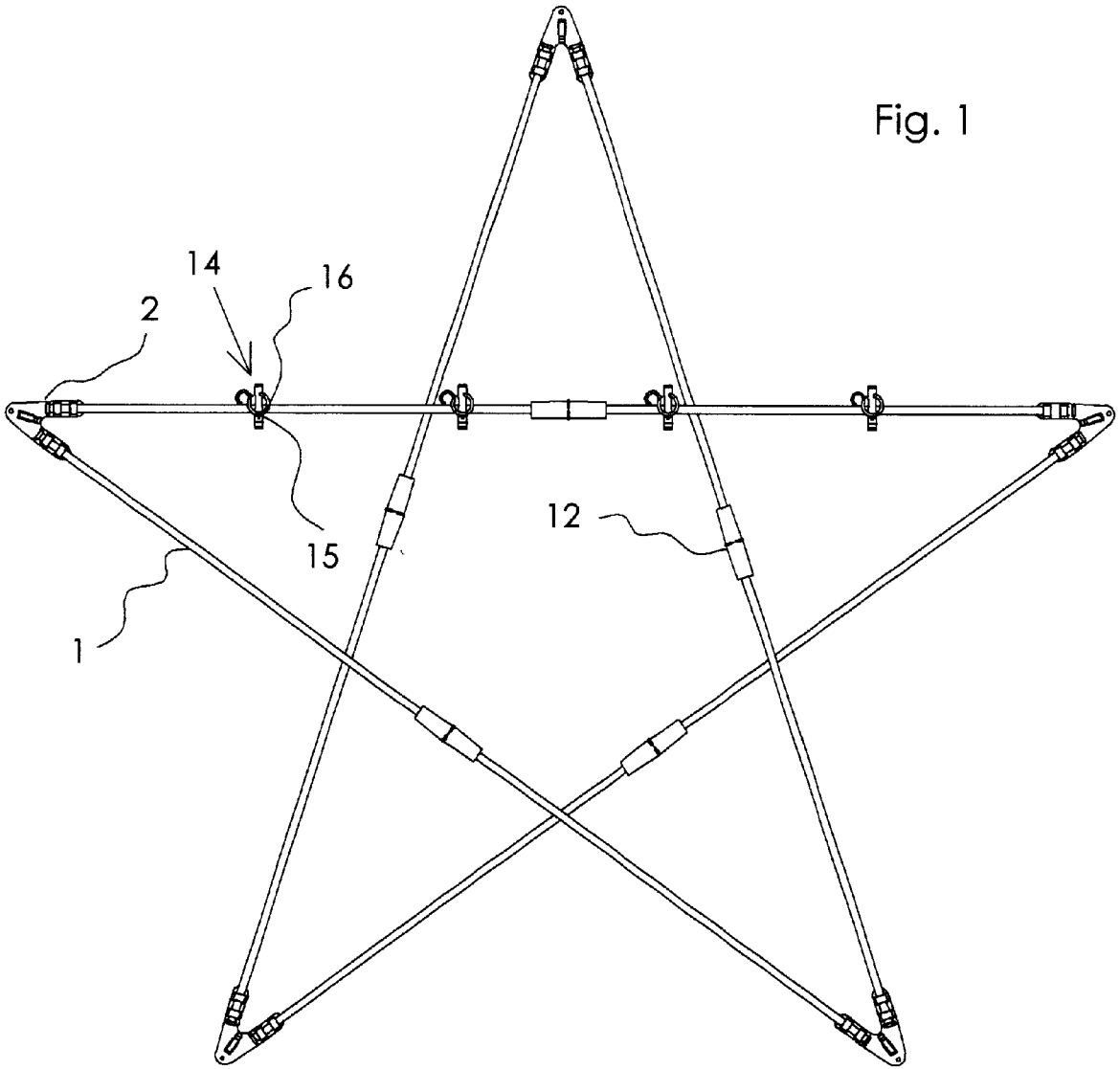
FIG. 1 is a front view of a present preferred embodiment of my outdoor ornament kit assembled to form a star shape with light holders shown only on one arm to simplify the illustration.
Figure 2:
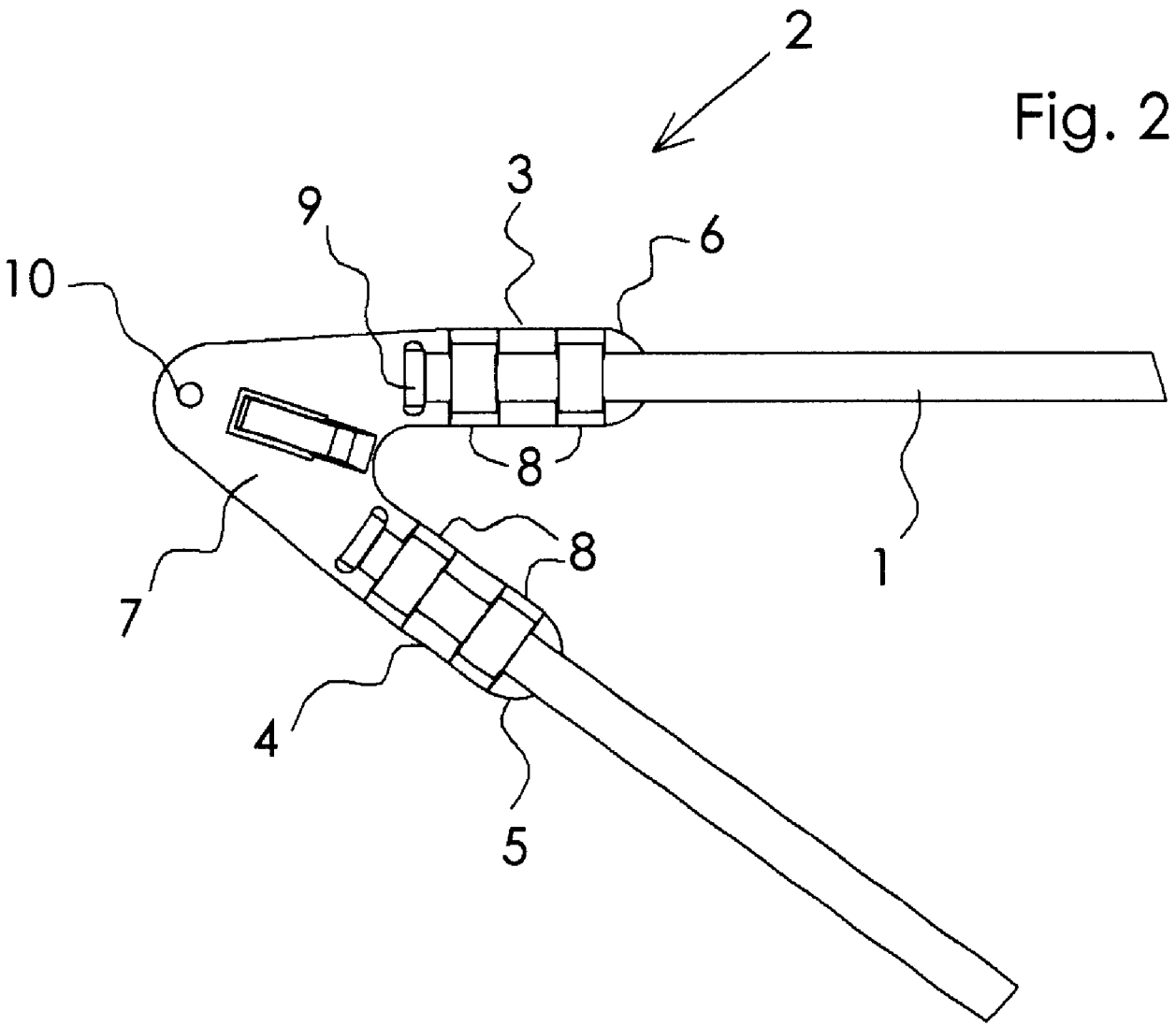
FIG. 2 is a top plan view of a present preferred rod connector used in the embodiment shown in FIG. 1.
Figure 9:
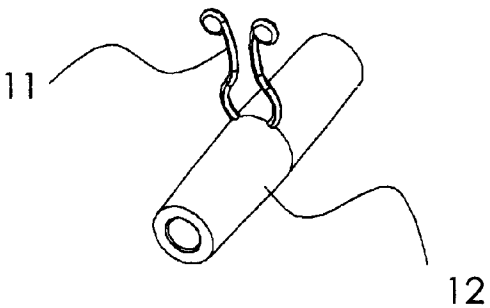
FIG. 9 is a perspective view of a fifth present preferred rod connector.

Referring now to the drawings wherein like reference numerals refer to similar or identical parts throughout the several views, a first presently preferred outdoor ornament kit assembled to form a star shape is shown in FIGS. 1 and 2. If desired, other decorative shapes could be created with this kit. For example, the Star of David or the Star of Bethlehem can be made. One could also create letters and designs such as a wave pattern. The kit contains a plurality of rods having sufficient flexibility relative to length so that if one rod is placed on a flat surface and a second rod is placed across the first rod, both ends of the second rod will touch the flat surface and the rod will not break when a force is applied by a person pushing those ends towards the flat surface. Thus, those ends will lie in a common plane with a point on the first rod 180° away from the point at which the first rod touches the second rod. I prefer to provide ten fiberglass rods having a diameter of ⅛ to ⅜ inches (3.8 to 9.5 mm) and a length of about three feet or one meter. The rod may have a circular, oval or polygon cross sectional shape. If a circular rod is used flat sections or a flat surface may be cut on the rod. Flat surfaces or nearly flat surfaces of an oval make it easier to attach and retain light holders having U-shaped clip mounting portions such as are disclosed in my U.S. Pat. No. 5,772,166. The rods 1 are held together by two types of rod connectors 2 and 12. The points of the star have the connector 2 shown in FIG. 2. Similar connectors are shown in FIGS. 3 through 8. As shown in FIG. 2, connector 2 has two arms 3 and 4. Each rod connector has a first end 5 and 6 and a second end 7 common with or connected to the other arm. The arms 3 and 4 are connected so that ends 5 and 6 are spaced apart a desired distance or arms 3 and 4 are at a selected angle. If desired, the arms may be pivotably connected at their second ends. I prefer to mold this connector from a fairly rigid polymer that allows some flexibility enabling the ends 5 and 6 to move in a direction normal to the top and bottom surfaces of the arms. Polyvinyl chloride having an 100 to 120 durometer is a suitable plastic for some applications. Polypropylene or K-resin could also be used. The arms should not be more that ¼ inch thick to provide sufficient flexibility. Each arm has a pair of spaced apart loops 8 sized and positioned to receive an end of a rod 1. I prefer to provide a stop 9 near the second end of the arm and collinear with the loops on that arm. Glue may be applied to the end of the rod before it is inserted through the loops 8. One could also secure the rod to the arm with a set screw, wire tie, irregular end or tread on the rod or pin passing through the end of the rod. The second type of rod connector is a simple tube 12 that fits over abutting ends of a pair of rods joined end to end. This tubular connector preferably is also a molded plastic part sized to provide a friction fit. A twist holder 11 may be molded onto the connector as shown in FIG. 9. This twist holder is sufficiently flexible so that its ends can be twisted together or interlocked. The ornament formed in the star shape of FIG. 1 can be attached to a flat surface, suspended by a rope or cable, or attached to one or more ground stakes or poles. Several stars could be made to hook together to form a fence or a self-supporting triangular or other structure of three or more stars. A hole 10 in the rod connector 2 is provided to mount or hang the ornament. I prefer to provide at least one half as many of each of the two types of connectors 2 and 12 as there are rods 1 in the kit.

In addition to rods and rod connectors, the kit also contains decorative light holders that fit onto the rods and hold either a socket or a cord of a string of decorative lights. Several such light holders 14 are shown on one arm of the star shape in FIG. 1. These light holders would preferably be placed on all arms of the star. Although the light holder could be simple U-shaped clips or wire ties, I prefer to provide light holders 14 having a mounting clip 15 that fits onto the rod 1 and a decorative light receiving portion 16 that grips the socket on a string of decorative lights. Suitable light holders are disclosed in my U.S. Pat. No. 5,772,166.

Figure 4:
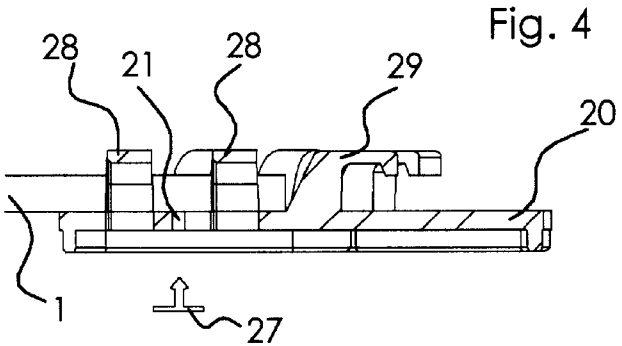
FIG. 4 is a cross-sectional view taken along the line IV—IV of FIG. 3.
Figure 3:
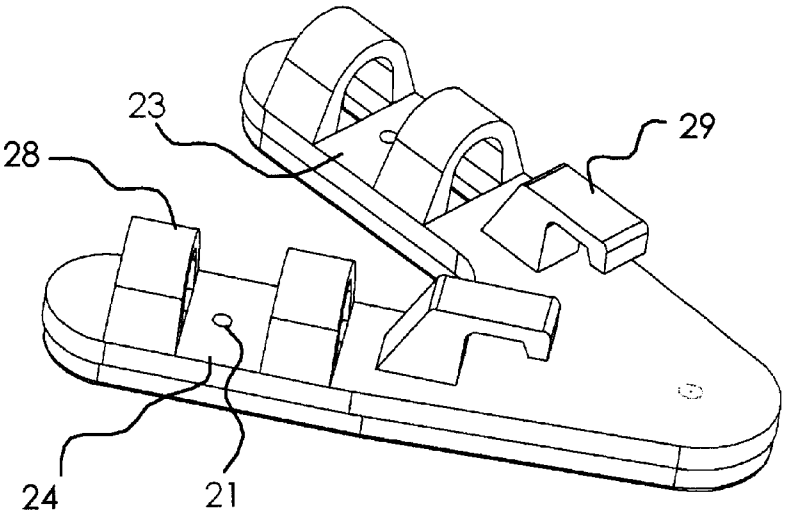
FIG. 3 is a perspective view of a second present preferred rod connector.
Figure 5:
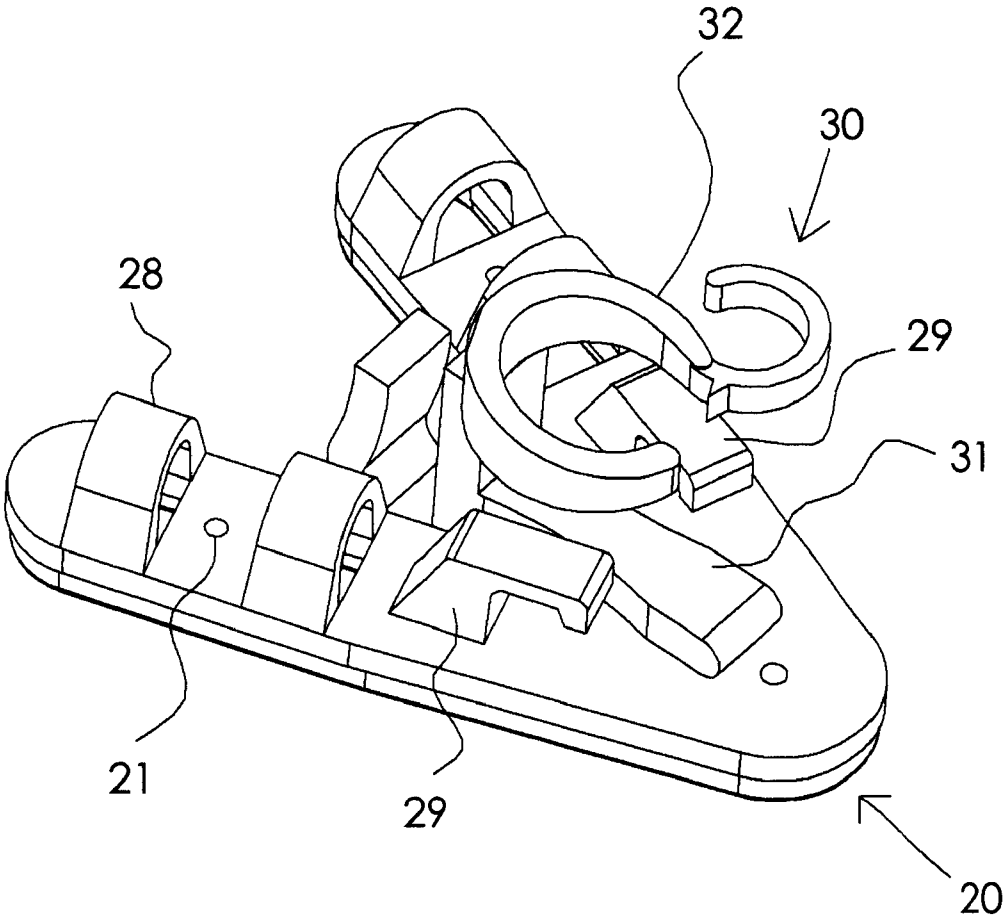
FIG. 5 is a perspective view of the rod connector of FIGS. 3 and 4 with a decorative light holder attached.

A second present preferred connector similar to the connector of FIG. 2 is shown in FIGS. 3, 4 and 5. This connector 20 has two arms 23 and 24 having one or more loops 28. It works better if the loop is beveled or tapered so that the rod fits in easily. Each arm also has a hook 29 which functions as a stop for the rod as well as a mount for a string of decorative lights. A hole 21 is provided in each arm between the loops 28 to receive a set screw 27 shown in FIG. 4. A decorative light holder 30 having a U-shaped mounting portion 31 and an S-shaped portion to receive a decorative light socket can be fitted onto the connector 2 as shown in FIG. 5.

Figure 7:
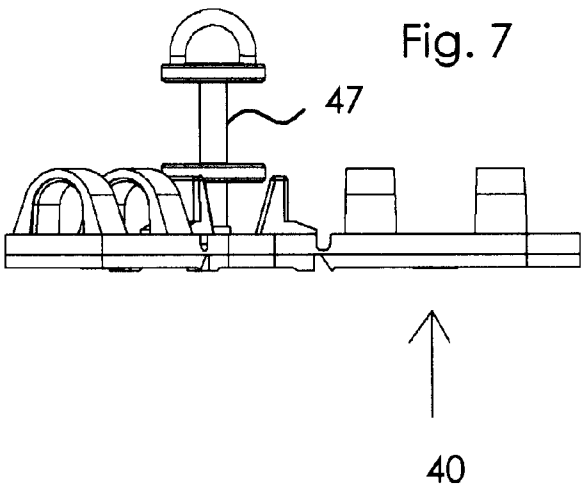
FIG. 7 is a side view of the connector of FIG. 6 to which an optional post has been added.
Figure 6:
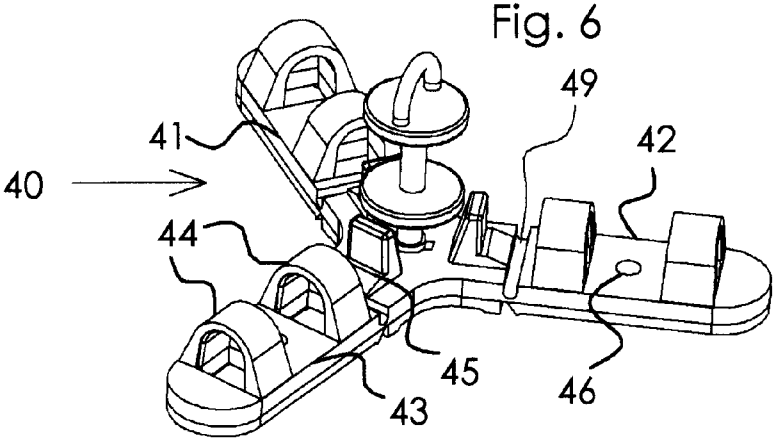
FIG. 6 is a perspective view of a third present preferred rod connector.

A third present preferred rod connector 40 is shown in FIGS. 6 and 7. This connector has three arms 41, 42 and 43. Each arm has a pair of loops 44 and a hump or ramp 45 that acts as a stop for the rod. The ramp forces the rod against the loop nearest the ramp. The stop 45 shown in FIG. 6 has both a ramp portion and an abutment. A hole 46 may be provided in each arm to receive a set screw. This connector is preferably made of a flexible plastic such as polyvinyl chloride. If desired a living hinge, indicated by dotted line 49 can be cut in one or more arms. One can also provide a post 47 at the intersection of the arms as shown in FIG. 7. Similar connectors can be made having four, five, six or more arms.

Figure 8:
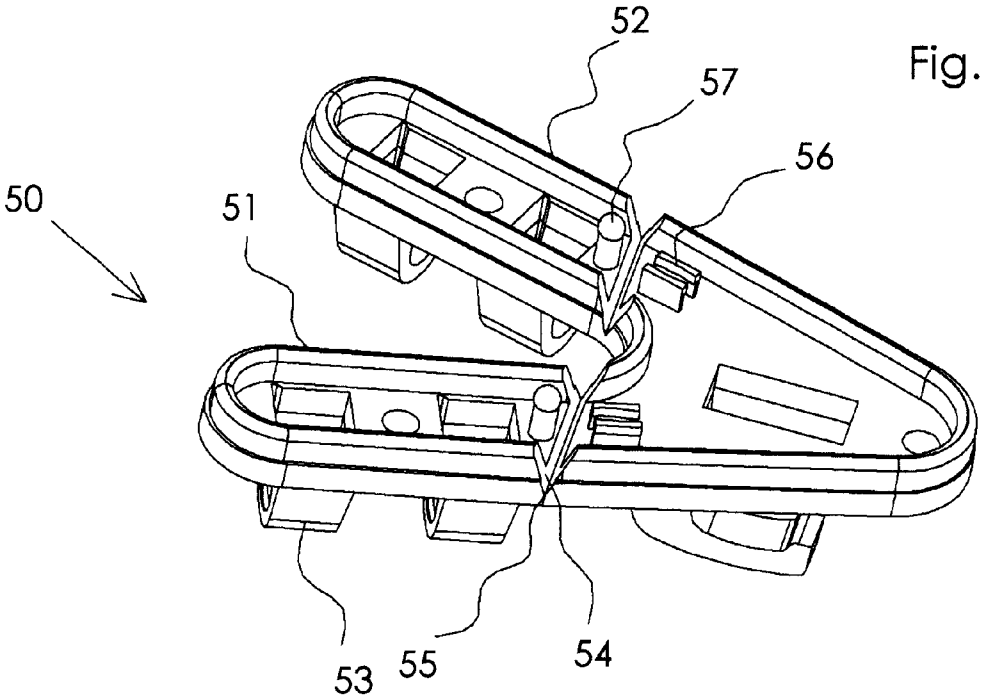
FIG. 8 is a perspective view showing the bottom of a fourth present preferred rod connector.

A fourth present preferred rod connector 50, shown in FIG. 8, is similar to the connector 20 shown in FIGS. 3, 4 and 5. This connector has two arms 51 and 52 attached together at one end. Each arm has two loops 53. A wedge 54 is cut in each arm to form a hinge 55. A clip 56 and tab 57 are provided adjacent the hinge on the bottom of each arm. Then the arm can be folded so that the clip 56 engages and grips the tab 57 holding the arm in a folded position. The angle of the wedge and the heights of the clip and tab will determine the angle at which the arm is held.

Figure 10:
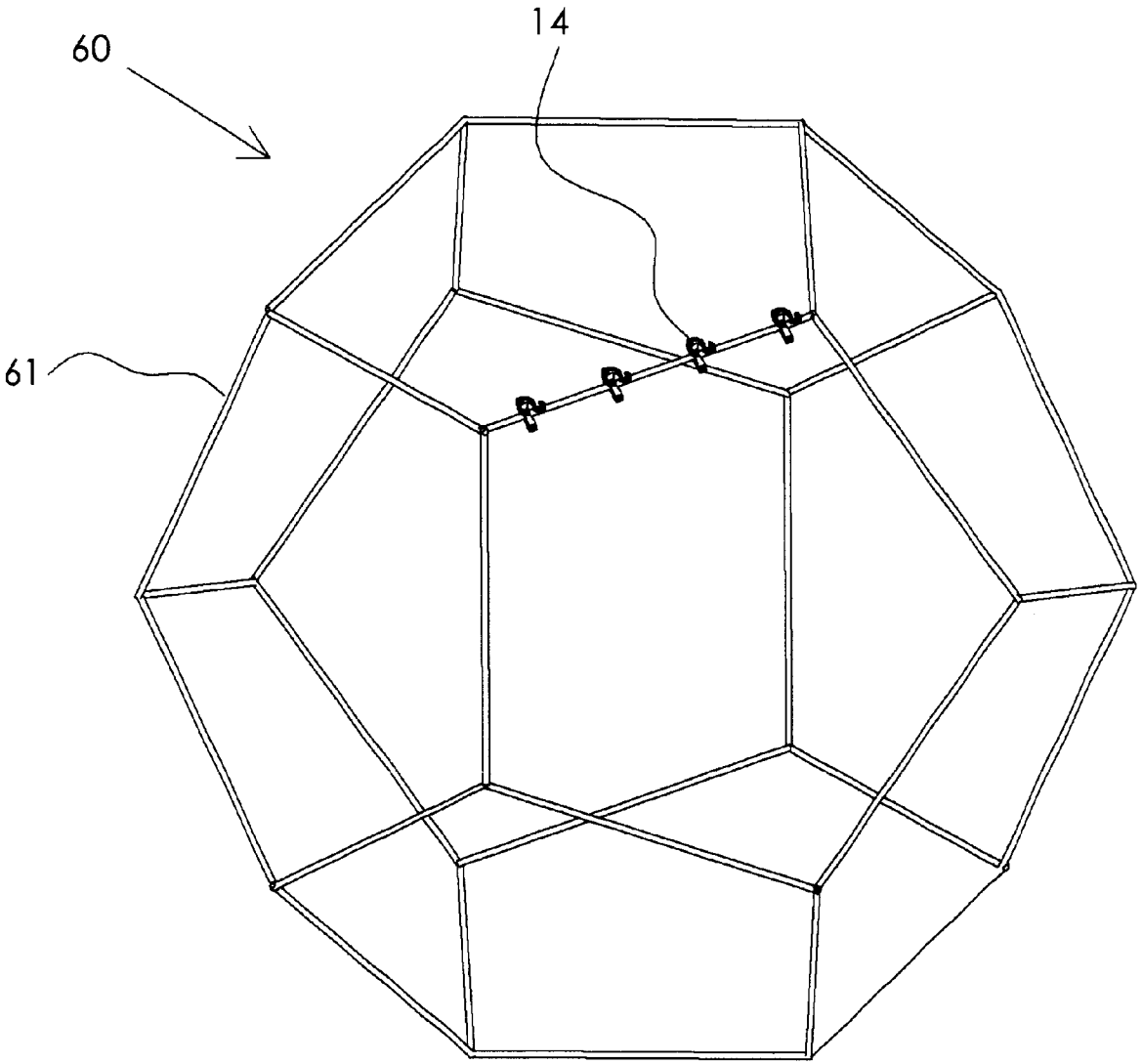
FIG. 10 is a perspective view of a present preferred embodiment of my outdoor ornament kit assembled into a dodecahedron a light holder.

The connector shown in FIGS. 6 and 7 is particularly useful for creating the three dimensional decoration 60 shown in FIG. 10. This dodecahedron has thirty rods 61 that define the edges of each of its twelve faces. Those faces are all pentagons. As in the decoration shown in FIG. 1 light holders may be attached to each rod to hold decorative light strings. For ease of illustration light holders 14 are shown on only one rod. However, it should be understood that light holders may be attached to all of the rods or and other selected number of rods. Another alternative is to suspend a light or other object inside of the dodecahedron. The structures may be placed within a plastic bag, colored and transparent, for different holidays. Orange bags, like pumpkins, may be used, for instance.

Figure 11:
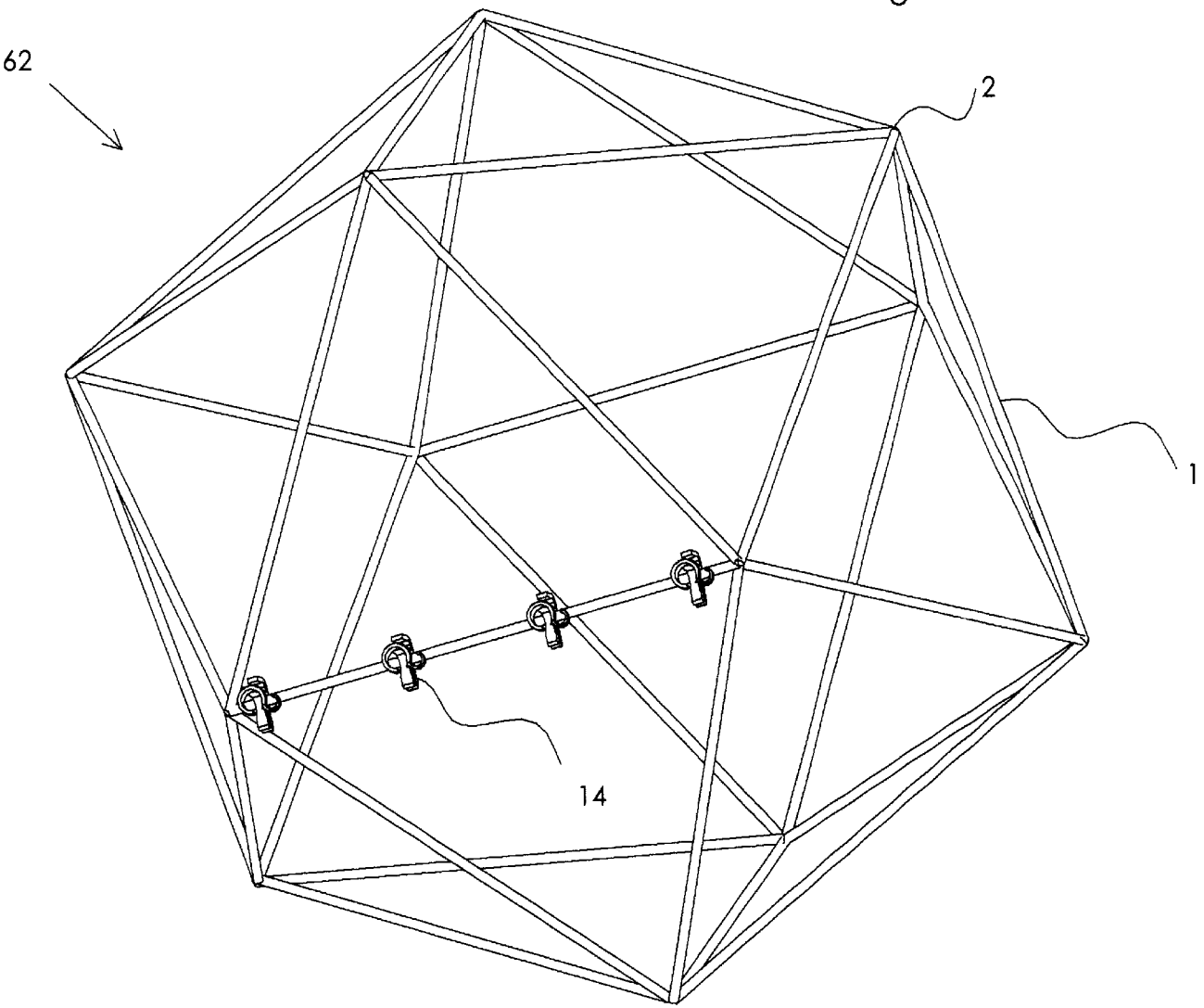
FIG. 11 is a present preferred embodiment of my outdoor ornament kit assembled into an isohedron.

The kit here disclosed can also be used to create a pyramid, cube or even a twenty faced, three-dimensional structure, or icosahedron, 62 shown in FIG. 11. This structure contains 30 rods 1 and twelve connectors 2. The connectors have five, flexible arms extending from a common center. The ends of the arms are equally spaced. A rod connector for a pyramid as well as a rod connector for a cube would have three arms meeting at a sixty or ninety degree angle.

Figure 12:
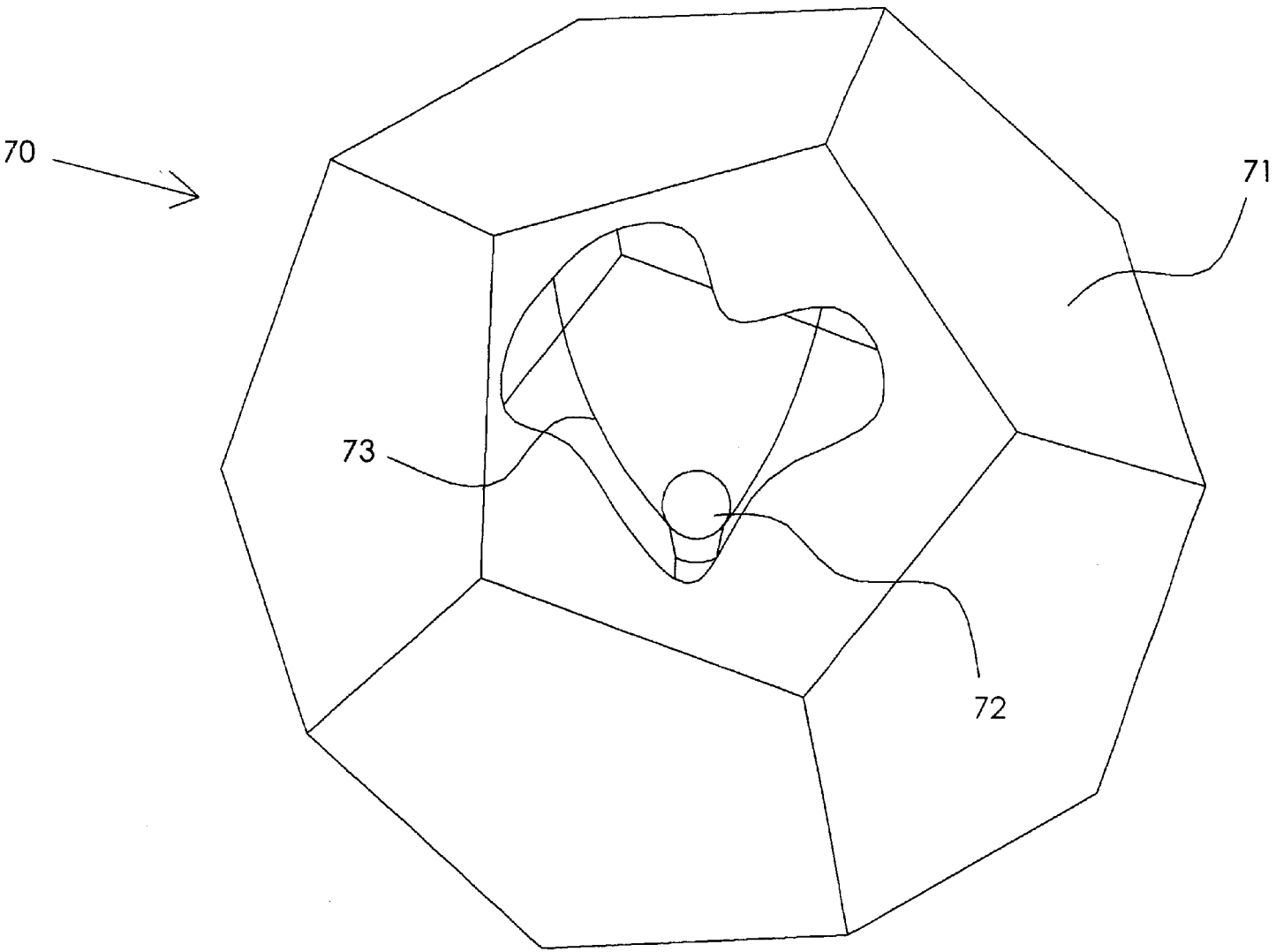
FIG. 12 is a perspective view showing the dodecahedron of FIG. 6 with a covering and optional interior light.

Any three-dimensional structures created with this kit, such as ornament 70 in FIG. 12, could be covered with a fabric or other material 71. The cover preferably is light transmissive. Consequently, one or more lights 72 can be placed within the ornament. The light or lights could be attached to one or more rods or suspended by cables 73 connected to some of the rods. If the fabric 71 were orange and a face was painted on the fabric, the ornament may look like a jack-o-lantern. A white fabric may cause the ornament to look like a snowball.

Although the invention has been described in detail in the foregoing embodiments for the purpose of illustration, it is to be understood that the invention is not so limited but may be variously embodied with the scope of the following claims.

I claim:

1. A kit for creating a decorative lawn ornament comprising:

a. a plurality of generally cylindrical rods having a same selected diameter, a first end and a second end, each rod being sufficiently flexible so that when any selected rod is placed across a second rod at a tangent point on the second rod, the selected rod can be flexed so that the ends of the first rod and a point on the second rod 180° from the tangent point will lie in a common plane;

b. a plurality of rod connectors, each rod connector comprised of at least two arms, each arm having a first end and a second end, the first end containing a socket sized to receive one end of one of the plurality of rods and the second end of each arm connected to a second end of another arm; and c. a plurality of decorative light holders, each light holder having a decorative light receiving portion sized and configured to hold at least one of a light socket and a cord of a string of decorative lights and also having a rod attachment portion sized and configured to attach the decorative light holder to one of the plurality of rods.

2. A kit for creating a decorative lawn ornament comprising:

a. a plurality of generally cylindrical rods having a same selected diameter, a first end and a second end, each rod being sufficiently flexible so that when any selected rod is placed across a second rod at a tangent point on the second rod, the selected rod can be flexed so that the ends of the first rod and a point on the second rod 180° from the tangent point will lie in a common plane;

b. a plurality of rod connectors, each rod connector comprised of at least two arms, each arm having a first end and a second end, the first end containing a socket sized to receive one end of one of the plurality of rods and the second end of each arm connected to a second end of another arm, wherein the sockets are comprised of a pair of spaced apart loops and a stop positioned to allow one end of a rod to pass through the loops and abut the stop; and c. a plurality of decorative light holders, each light holder having a decorative light receiving portion sized and configured to hold at least one of a light socket and a cord of a string of decorative lights and also having a rod attachment portion sized and configured to attach the decorative light holder to one of the plurality of rods.

3. The kit of claim 1 also comprising a set screw in at least one arm of at least one connector, the set screw positioned to engage an end of a rod when that end is within the socket contained by the at least one arm.

4. The kit of claim 1 wherein the at least two arms are connected to one another in a manner to allow the first ends of the arms to move relative to one another.

5. The kit of claim 1 also comprising a living hinge in an arm of at least one of the rod connectors.

6. The kit of claim 1 also comprising a plurality of tubular connectors sized to connect two of the rods together end to end.

7. A kit for creating a decorative lawn ornament comprising:

a. a plurality of generally cylindrical rods having a same selected diameter, a first end and a second end, each rod being sufficiently flexible so that when any selected rod is placed across a second rod at a tangent point on the second rod, the selected rod can be flexed so that the ends of the first rod and a point on the second rod 180° from the tangent point will lie in a common plane;

b. a plurality of rod connectors, each rod connector comprised of at least two arms, each arm having a first end and a second end, the first end containing a socket sized to receive one end of one of the plurality of rods and the second end of each arm connected to a second end of another arm;

c. plurality of decorative light holders, each light holder having a decorative light receiving portion sized and configured to hold at least one of a light socket and a cord of a string of decorative lights and also having a rod attachment portion sized and configured to attach the decorative light holder to one of the plurality of rods;

d. a plurality of tubular connectors sized to connect two of the rods together end to end; and e. a twist holder attached to each of at least some of the plurality of tubular connectors.

8. A kit for creating a decorative lawn ornament comprising:

a. a plurality of generally cylindrical rods having a same selected diameter, a first end and a second end, each rod being sufficiently flexible so that when any selected rod is placed across a second rod at a tangent point on the second rod, the selected rod can be flexed so that the ends of the first rod and a point on the second rod 180° from the tangent point will lie in a common plane;

b. a plurality of rod connectors, each rod connector comprised of at least two arms, each arm having a first end and a second end, the first end containing a socket sized to receive one end of one of the plurality of rods and the second end of each arm connected to a second end of another arm wherein at least one of the rod connectors also comprises at least one hook attached to the at least two arms; and c. a plurality of decorative light holders, each light holder having a decorative light receiving portion sized and configured to hold at least one of a light socket and a cord of a string of decorative lights and also having a rod attachment portion sized and configured to attach the decorative light holder to one of the plurality of rods.

9. The kit of claim 1 wherein the plurality of rod connectors has a cross-sectional shape selected from the group containing of circle, oval and polygons.

10. The kit of claim 1 wherein the arms of the rod connectors are positioned to enable the plurality of rods to be connected to form a geodesic dome.

11. The kit of claim 10 also comprising a cover sized to fit over the geodesic dome.

12. The kit of claim 11 wherein the cover is light transmissive.

13. The kit of claim 1 wherein the rods are fiberglass.

14. The kit of claim 1 wherein the rod connectors are a plastic selected from the group consisting of polyvinyl chloride of 100 to 120 durometer, polypropylene and polycarbonate.

15. A kit for creating a decorative lawn ornament comprising:

a. a plurality of generally cylindrical rods having a same selected diameter, a first end and a second end, each rod being sufficiently flexible so that when any selected rod is placed across a second rod at a tangent point on the second rod, the selected rod can be flexed so that the ends of the first rod and a point on the second rod 180° from the tangent point will lie in a common plane;

b. a plurality of rod connectors, each rod connector comprised of at least two arms, each arm having a first end and a second end, the first end containing a socket sized to receive one end of one of the plurality of rods and the second end of each arm connected to a second end of another arm wherein the rod connectors have at least one post hole;

c. a plurality of posts, each post having an end sized to fit within the at least one post hole; and d. a plurality of decorative light holders, each light holder having a decorative light receiving portion sized and configured to hold at least one of a light socket and a cord of a string of decorative lights and also having a rod attachment portion sized and configured to attach the decorative light holder to one of the plurality of rods.

16. A kit for creating a three-dimensional decorative lawn ornament having at least 4 sides comprising:

a. a plurality of generally cylindrical rods having a same selected diameter, a first end and a second end, each rod being sufficiently flexible so that when any selected rod is placed across a second rod at a tangent point on the second rod, the selected rod can be flexed to that the ends of the first rod and a point on the second rod 180° from the tangent point will lie is a common plane;

b. a plurality of rod connectors, each rod connector comprised of at least two arms, each arm having a first end and a second end, the first end of each arm containing a socket sized to receive one of the plurality of rods and the second end of each arm connected to all other arms such that there is substantially the same angle between any two adjacent arms.

17. The kit of claim 16 also comprising a cover sized to fit over the plurality of rods and plurality of rod connectors when assembled into a three-dimensional structure having at least 4 sides.

18. The kit of claim 17 wherein the cover is light transmissive.

19. The kit of claim 1 wherein at least one of the rod connectors has a hole from which an ornament created from the kit can be hung.

* * * * *